US005371927A

United States Patent [19]

Aussedat

[11] Patent Number: 5,371,927

[45] Date of Patent: Dec. 13, 1994

[54] PULL TAB FOR SLIDE FASTENER AND A SLIDE FASTENER INCORPORATING SUCH PULL TAB

[75] Inventor: Franck Aussedat, Annecy le Vieux, France

[73] Assignee: Salomon S.A., Annecy Cedex, France

[21] Appl. No.: 976,998

[22] PCT Filed: May 11, 1992

[86] PCT No.: PCT/FR92/00419

§ 371 Date: Feb. 3, 1993

§ 102(e) Date: Feb. 3, 1993

[87] PCT Pub. No.: WO93/00026

PCT Pub. Date: Jan. 7, 1993

[30] Foreign Application Priority Data

Jun. 21, 1991 [FR] France ..... 91 07907

[51] Int. Cl.[5] ..... A44B 19/26

[52] U.S. Cl. ..... 24/429; 24/415

[58] Field of Search ..... 24/415, 429, 431

[56] References Cited

U.S. PATENT DOCUMENTS

| | | | |
|---|---|---|---|
| 3,833,144 | 9/1974 | Bollman et al. | 220/267 |
| 4,251,582 | 2/1981 | Bernier et al. | 24/415 X |
| 4,873,750 | 10/1989 | Tracy | 24/429 |
| 4,949,434 | 8/1990 | Minami | 24/429 |
| 4,974,297 | 12/1990 | Akashi | 24/429 |
| 4,976,015 | 12/1990 | Ishii | 24/429 |
| 4,984,338 | 1/1991 | Akashi | 24/429 X |
| 5,007,144 | 4/1991 | Terada et al. | 24/415 |
| 5,105,512 | 4/1992 | Aussedat | 24/429 |

FOREIGN PATENT DOCUMENTS

| | | |
|---|---|---|
| 0291816 | 11/1988 | European Pat. Off. . |
| 0369258 | 5/1990 | European Pat. Off. . |
| 0369438 | 5/1990 | European Pat. Off. . |
| 0398172 | 11/1990 | European Pat. Off. . |
| 2656511 | 7/1991 | France . |

*Primary Examiner*—Edward K. Look
*Assistant Examiner*—John Ryznic
*Attorney, Agent, or Firm*—Sandler, Greenblum & Bernstein

[57] ABSTRACT

A pull tab for manipulating a slide of a slide fastener and a slide fastener incorporating such pull tab. The pull tab is made of a synthetic elastomer, wherein the synthetic elastomer is a polyether amide block copolymer.

2 Claims, 1 Drawing Sheet

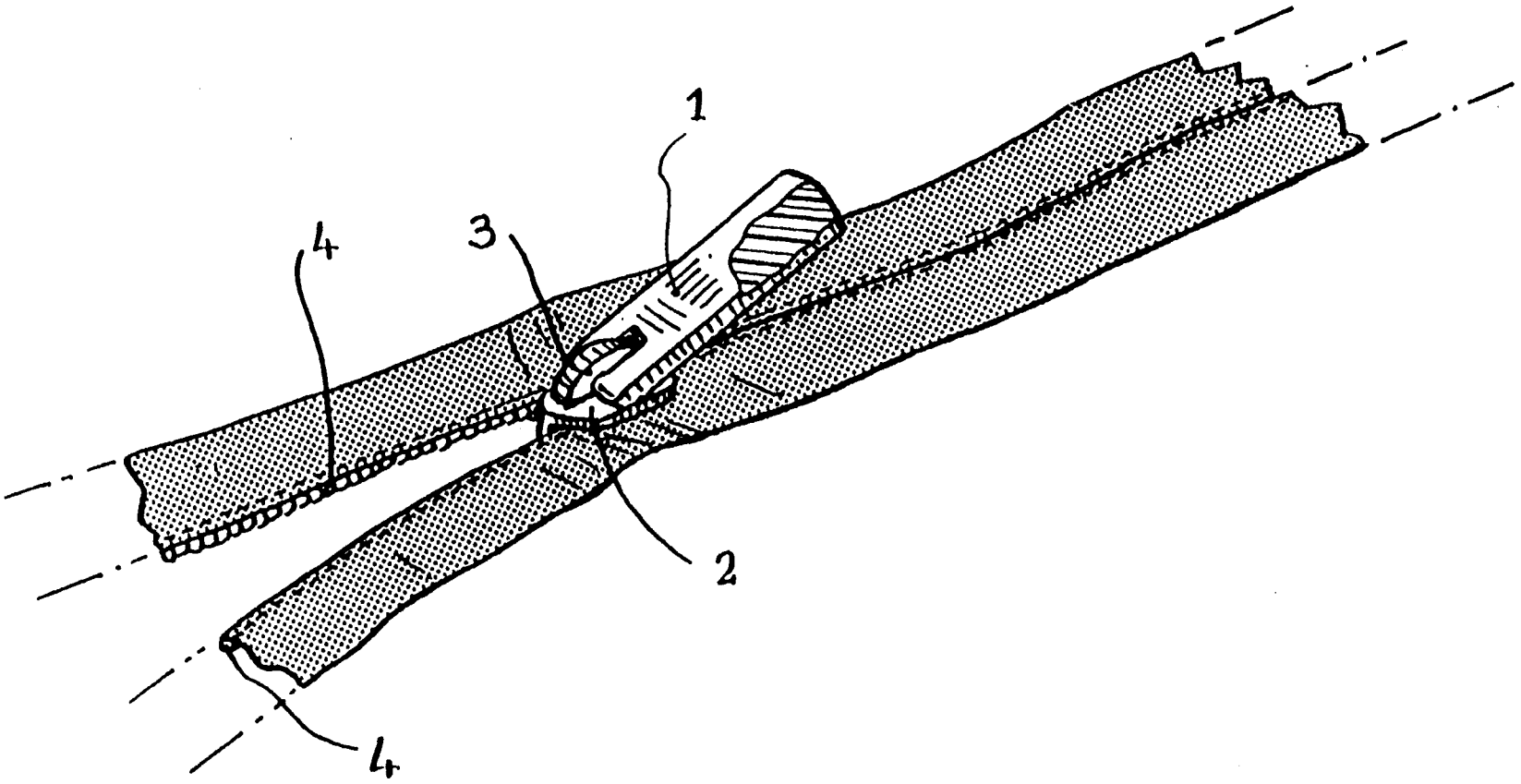
1
2
3
4
4

PULL TAB FOR SLIDE FASTENER AND A SLIDE FASTENER INCORPORATING SUCH PULL TAB

BACKGROUND OF THE INVENTION

1. Field of the Invention

The present invention is related to a pull tab enabling the manipulation of the slider of a slide fastener, as well as a slide fastener equipped with such a pull tab, and adapted especially for the closure of shoes, clothes, handbags and other items.

2. Discussion of Background and Relevant Information

Pull tabs for slide fasteners are traditionally constituted of a metallic material. In view of the substantial forces exerted often by the user, they must in fact have great endurance to shock and torsion. But such metallic materials (various alloys, stainless steel, etc.) are rigid materials and, therefore, are almost incapable of deformation, torsion or flexion, which promote tearing of the connector bar, or a deformation of the critical portions of the pull tab, especially when the slide fasteners are located in areas that cannot be easily accessed by the user, such as winter sports boots, for example, wherein gripping with gloves is not easy.

On the other hand, if the closure elements are torn off accidentally, the presence of metallic elements can result in injuries to the user.

Attempts to overcome these disadvantages were directed to considering synthetic materials that were presently commercially available and which were determined to be capable of overcoming the disadvantages of the prior state of the art regarding the manufacture of pull tabs for slide fasteners.

U.S. Patent No. 4,949,434 proposed the manufacture of pull tabs enabling manipulation of the slider of a slide fastener, constituted of a synthetic material having properties of elasticity, such as a synthetic elastomer, and especially a polyester elastomer.

The amorphous phase of such copolymers is of the ester or ether type, whereas the rigid phase is of the polybutylene terphthalate type.

This choice of material does have disadvantages, however. In particular, polyester or polyether block ester elastomers are extremely sensitive to ultra-violet radiation. Although their yellowing is limited, their mechanical characteristics decrease sharply with prolonged exposure. As such, they must be provided with anti-UV protection by means of appropriate additives.

On the other hand, they are often difficult to dye and their resistance to wear and tear due to abrasion is not always satisfactory.

Also considered was the use of urethane polyether block copolymers. In these copolymers, the amorphous sequence is constituted by the reaction product of a long chain polyol having an isocyanate, while the rigid sequence results from the action of an isocyanate having a very short glycol chain. This type of copolymer owes its reinforcing characteristic to the hydrogen links located between the polymer chains.

These copolymers have excellent resistance to traction as well as to wear and tear by abrasion, but it must be noted that they become substantially yellow under exposure to ultraviolet rays and also that a large number of such polymer types display a pronounced rigidity at low temperatures.

SUMMARY OF THE INVENTION

It is an object of the present invention to provide a slide fastener, including a pull tab, which is not afflicted with the disadvantages of the prior art.

More particularly, it is an object of the invention to determine, among synthetic thermoplastic polymers, which are easier to work with than thermohardenables, those that are suited for the manufacture of pull tabs for slide fasteners.

The selection criteria according to the invention were determined to be the following:

ease of manufacture, by injection and/or molding;

ease of dyeing (this factor is very important for pull tabs, since pull tabs are adapted to be used on boots, bags and clothing where the fashion aspect is extremely important);

shiny appearance (once again for aesthetic reasons);

the material must display, in addition, the indispensable characteristics of elongation, flexibility, tenacity, endurance, resistance to shock and resistance to traction and torsion;

these characteristics must be retained at low temperatures (this factor is indispensable especially for articles adapted to be used in the severe temperature conditions of winter sports); and the materials retained should not be excessively sensitive to ultra-violet rays.

With regard to the aforementioned objects of the invention, particularly with regard to the determination of synthetic thermoplastic polymers that are suited for the manufacture of pull tabs for slide fasteners and the aforementioned selection criteria according to the invention, an initial analysis tended to favor, among the numerous thermoplastic polymers, those elastomers that are known to be easy to manufacture, at a substantial rate, and that are easy to transform with relatively simple injection means, and that are, in addition, easy to dye.

Indeed, tests undertaken with some other rigid thermoplastic polymers such as polyoxymethylenes (POM) or polyacetals (of the type marketed under the trademark DELRIN) did not provide satisfactory results; these excessively rigid materials ruptured during torsion tests. Moreover, they are sensitive to the effect of ultra-violet rays.

Thermoplastic elastomers are materials adapted to fulfill common physical characteristics, such as, for example, less rigidity, substantial elongation at tears, and in the majority of cases, a total absence of an elasticity threshold, corresponding to an extremely amorphous product.

Their performance can be compared to those of traditional elastomers, in a wide temperature range, and they can also be shaped like thermoplastic polymers.

Products corresponding to this definition include, in addition to synthetic rubber, silicon elastomers as well as the entire range of sequenced thermoplastic copolymers, such as polyether-urethane block copolymers, polyether-ester block copolymers and polyetheramide block copolymers.

These sequenced thermoplastic copolymers are, in fact, copolymers formed in two phases, one amorphous and the other crystalline, located in sequences along the molecular chains.

By playing with electromagnetic interactions, the crystalline zones are grouped in fields that are uniformly distributed in the amorphous zones.

At the working temperature, lower than the vitreous transition temperature $T_v$ of the thermoplastic phase, the thermoplastic zones constitute the reversible physical cross-linking nodes which confer, to these materials, a behavior similar to that of traditional elastomers after vulcanization.

BRIEF DESCRIPTION OF THE DRAWING

In the single drawing FIGURE, a slide fastener including the pull tab, according to the invention, is shown in a perspective view in partial cross-section.

DETAILED DESCRIPTION OF THE PREFERRED EMBODIMENTS

In accordance with the invention, the slide fastener and the slider attached thereto can be of any known type. As can be seen, for example, in the single drawing FIGURE, the slider 2 has a connector bar 3 to which the pull tab 1 is secured, enabling the manipulation of slider 2. The base of the slider 2 cooperates in a traditional manner with slide fasteners 4.

A new selection of material according to the aforementioned selection criteria, made from among other block copolymers, proved that for the application according to the invention, polyether amide block copolymers are very appropriate, especially in view of their ease of dyeing and their improved resistance properties to wear and tear due to friction.

In these polyether amide block copolymers, the amorphous sequence is constituted by an extremely amorphous ether phase which provides the flexibility properties.

The rigid sequence is obtained from Polyamide 6 or Polyamide 12 type chain sections.

The pull tab enabling the manipulation of the slider of a slide fastener according to the invention, of the synthetic elastomer type, includes an elastomer chosen from among polyether amide block copolymers.

It is important to highlight the original properties of such copolymers, which proved to be particularly interesting in the field of application of the invention.

They have excellent qualities of flexibility, tenacity and endurance. Their shore hardness varies from 80 Sh A to 70 Sh D; their resistance to shock at low temperatures is very good.

On the other hand, their excellent flexibility in traction and in flexion, in temperatures ranging from −40° C. to +80° C. enables them to be used under difficult circumstances whenever it is necessary to guarantee substantial deformations, which is indeed the case for pull tabs that are manipulated frequently in severe weather conditions.

Finally, these copolymers are especially easy to dye, and this enables the production of pull tabs in all fashionable shades, and their shiny appearance is very pleasant to behold.

The pull tab obtained from amide block copolymers in accordance with the invention can be especially adapted to be utilized in connection with the types of pull tabs described in commonly assigned French Patent Publication No. 2,656,511, published on Jul. 5, 1991. This pull tab can, regardless of the position of the slider along the slide fastener, be immobilized with respect to the actual slider, in at least one stable position, especially a neutral position, by application of the slide fastener.

By virtue of the material used in the present invention, one can vary the elasticity of the material, so that the transmission of the torsion couple and flexional forces on the connector bar are reduced to almost nothing, and at the same time, the pull tab is provided with a greater section and generally larger dimensions, especially in length, by increasing its durability as well as ease of grip, even with a gloved hand.

The present invention is naturally not limited to only this type of pull tab for slide fasteners, and can find an application in other existing designs.

What is claimed is:

1. A pull tab for manipulating a slider of a slide fastener, the pull tab comprising:

a member made of a synthetic elastomer, said synthetic elastomer comprising a polyether amide block copolymer.

2. A slide fastener comprising:

a slider for opening and closing said slide fastener; and a pull tab connected to said slider for manipulating said slider along the slide fastener, said pull tab comprising a synthetic elastomer, said synthetic elastomer comprising a polyether amide block copolymer.

* * * * *